United States Patent [19]

Vilanova

[11] 4,362,248

[45] Dec. 7, 1982

[54] ORGANIZATIONAL AID DEVICE

[76] Inventor: Jorge O. Vilanova, Calle Balmes 361, Barcelona, Spain

[21] Appl. No.: 76,931

[22] Filed: Sep. 19, 1979

[30] Foreign Application Priority Data

Sep. 30, 1978 [ES] Spain ..... 238.455[U]

[51] Int. Cl.[3] ..... A47F 7/00

[52] U.S. Cl. ..... 211/50; 211/13

[58] Field of Search ..... 211/50, 51, 87, 13; 40/2 A, 19.5, 120

[56] References Cited

U.S. PATENT DOCUMENTS

| | | | |
|---|---|---|---|
| 774,495 | 11/1904 | Richard | 211/50 |
| 1,626,883 | 5/1927 | Smith | 40/19.5 |
| 2,149,978 | 3/1939 | Noel | 211/50 X |
| 2,314,473 | 3/1943 | Barlow | 211/50 |
| 3,458,946 | 8/1969 | Lasswell | 40/19.5 |
| 4,100,684 | 7/1978 | Berger | 211/50 X |
| 4,143,847 | 3/1979 | Cross | 40/120 X |

FOREIGN PATENT DOCUMENTS

| | | | |
|---|---|---|---|
| 1024846 | 1/1978 | Canada | 211/13 |

*Primary Examiner*—Roy D. Frazier
*Assistant Examiner*—Robert W. Gibson, Jr.
*Attorney, Agent, or Firm*—Steinberg & Raskin

[57] ABSTRACT

An organizational aid device includes a board which may be mounted on a wall or desk. The board bears various pigeonholes and/or compartments which are labelled with their respective functions, including receiving mail. A cardholder holds cards which correspond to days of the week and on which relevant notes can be made. Desk-like supports for making notes are mounted in a plane suitably inclined to the board. They may be removable, and remountable in different positions in the same inclined plane. There are further supports for writing implements, a telephone list, keys, and optionally an adjustable calendar.

3 Claims, 4 Drawing Figures

ORGANIZATIONAL AID DEVICE

BACKGROUND OF THE INVENTION

The present invention relates to an organisational aid device which may be of use in coordinating activities e.g. in a household or an office.

At the present time various means are known for making notes, giving reminders, leaving instructions, and other similar functions. Such means however are separate and uncoordinated, each serving only a single function. Thus many such means are needed, but this is inconvenient and inefficient.

Consider for example what happens in a large family, in which the housewife needs to organise her tasks, purchases, and administrative or other duties. These will to a large extent be affected by the activities of the other members of the family, and these activities will be numerous, particularly if some members of the family enjoy a certain autonomy. It is necessary to coordinate timetables, departures, absences, holidays, examinations, social visits, and innumerable other activities, to which must be added the taking of telephone message, memoranda, and other similar needs.

Although a different type of activity is concerned, the same organisation function arises in an office, a commercial centre or department where there are activities of any kind, whether relating to work or otherwise, for which the functions of a group of persons have to be coordinated.

SUMMARY OF THE INVENTION

According to the present invention there is provided an organisational aid device comprising:

support means, suitably of laminar construction, e.g. a board, said means having a front face on and/or behind which are defined a plurality of compartments accessible from the front of the device, at least one of which is constructed and arranged for receiving mail;

respective indicia associated with at least some of said compartments for indicating their functions (e.g. relating to specific persons, days of the week or tasks);

a cardholder mounted on said front face and containing a plurality of cards, each of which bears a respective marking denoting a respective period of time (e.g. a day of the week), each card having a surface portion for the recording thereon of information relating to said respective period, said cards being removably and interchangeably mounted in overlying relationship in said cardholder so that at least a part of said surface-portion of the front said card is visible and accessible from the front of the device;

a generally planar carrier member for a notepad; mounting means for mounting said carrier member on said support member at an angle inclined to the front face thereof such that said carrier member is at an angle appropriate for writing on a notepad supported on said carrier member;

means for removably mounting an information-bearing element such as a list of telephone numbers on said front face with information on said element displayed;

at least one holder (e.g. a tray) for writing implements, said holder being mounted on said front face; and a plurality of hook means on said front face for detachably securing small objects such as keys to said support means.

The device according to the invention can be synoptic, cenntralised, and very simple in construction but extremely effective. It can greatly facilitate the coordination of diverse activities.

Preferably the notepad carrier is in a plane inclined in the manner of a writing-desk, and can assume at least two different stable angular positions within that plane.

The device may also be provided with a compartment containing an annular calendar in the form of a card, which normally remains hidden in the compartment, except for its top edge, there being in the compartment a spring urged against this card to enable it to be held in positions, with variable amounts projecting from the compartment and therefore visible.

DESCRIPTION OF A PREFERRED EMBODIMENT

Figure 1:
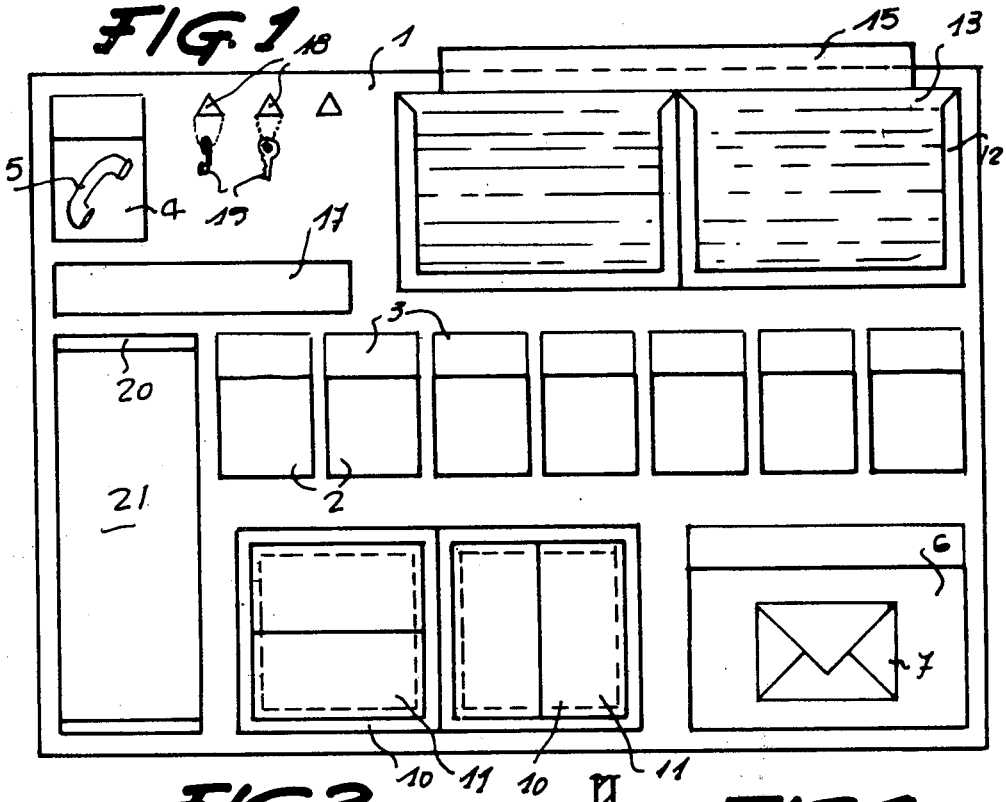
FIG. 1 is a front view in elevation of a display device embodying the invention.
Figure 2:
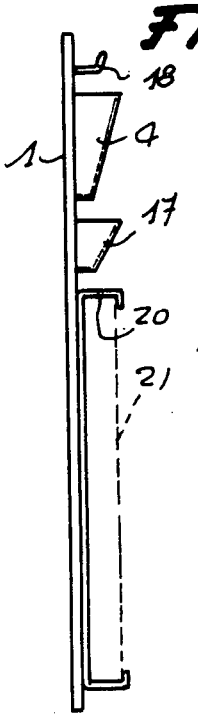
FIG. 2 is a side view thereof.
Figure 3:
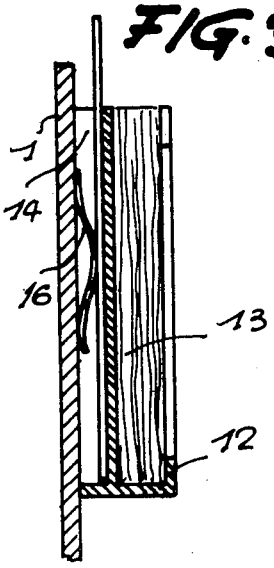
FIG. 3 is a longitudinal section through part of the device including a cardholder and a compartment containing a calendar.

A board 1 is equipped with a number of compartments or pockets 2 bearing indicia 3, which may for example indicate the days of the week, the names of persons, or the names of activities.

At another region of the board there is a compartment 4 which bears a representation 5 of a telephone, and which is intended for telephone messages. Another compartment 6, larger than the ones previously mentioned, is intended for mail and bears an identifying symbol 7.

Figure 4:
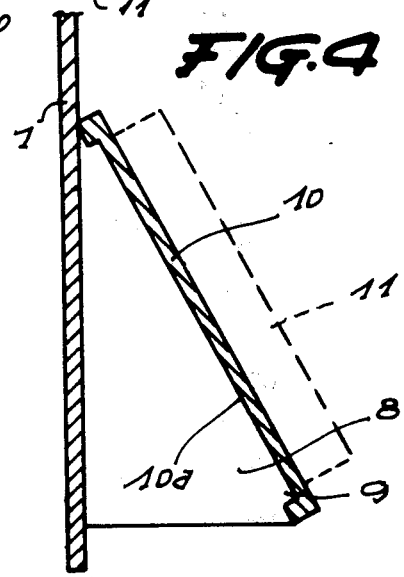
FIG. 4 is a view in longitudinal section through another part of the device showing a desk assembly.

Projecting out from the board 1 are two identical angled bases 8 disposed side by side. Each is a triangular prism whose cross-section is a right-angled triangle (see FIG. 4), with a vertical side secured to the board 1, and the hypotenuse inclined downwardly away from the board 1. The inclined face of each base 8 has a central symmetrical square raised section 9. A pair of flat elements which serve as writing-desks 10 each have a square recess **10*a* in their backs complementary to a raised section 9. By interengagement of elements 9 and 10*a*, a desk 10 can be mounted on a base 8. The desk 10 can be simply lifted off and used elsewhere, or it can be rotated through one or more right angles and remounted. Notepads 11 are secured to the desks 10, and can be arranged upright or sideways (as seen respectively on the right and left desks in FIG. 1) as desired by repositioning the desks 10 on the bases 8**.

At the top part of the board are two or more adjoining cardholders 12, which contain cards 13 which correspond to the days of the week and may be marked accordingly, on each of which notes can be made.

Behind these cardholders is situated a compartment 14 containing a card 15 which constitutes a calendar. A spring 16 presses on the card 15 enabling it to be positioned in stable, projecting positions. When fully retracted into the compartment 14, the card still projects slightly so that it can easily be moved to a position of greater projection from the compartment 14.

The board 1 is provided with a tray 17 for containing small objects, such as pencils, and also with hooks or hangers 18 for holding keys 19.

Finally, the board 1 has some guides 20 for mounting, by lateral sliding between them, a telephone list 21.

By means of the device described it is possible to make notes on the pads 11 in the vertical or horizontal position as preferred, with great ease because of the inclination of the desk 10, and with the aid of the writing implements which are stored in the tray 17. The bottom of the tray 17 is curved in order to facilitate picking up the writing implements or other objects contained therein. A desk 10 can easily be detached for making notes elsewhere. The notes can be placed in the appropriate compartments 2. These may be classified according to person, day of the week, subject, or anything else desired, the classifications being indicated at 3.

Telephone messages can be placed in the pigeonhole 4 and correspondence in the compartment 6.

Notes for future days can be made on the cards 13, which in the case illustrated are assumed to correspond to two consecutive weeks. Information regarding dates can be obtained from the calendar 15.

As will be appreciated, the device constitutes a true control and planning centre, in which notes can be made and read by many different people. The device may have numerous applications, either commercial or domestic, since the function can be varied simply by altering the identifying symbols on some of the pigeonholes in order to adapt them to another function. The device 4 provides all that is necessary for the organisation, execution and reminding of tasks of any kind.

The board can be equipped with other and/or additional devices, such as a cork mat for pinning items to, a lamp, or a clock, which extends the possible applications of the board.

I claim:

1. An organisational aid device comprising:

support means having a front face and provided with a plurality of compartments accessible from the front of said support means, one of said compartments being constructed and arranged for receiving mail;

respective compartment-identifying indicia associated with at least some of said compartments;

a cardholder mounted on said front face;

a plurality of cards each bearing a respective marking denoting a respective period of time, each card having a surface-portion for the recording thereon of information relating to said respective period, said cards being removably and interchangeably mounted in mutually overlying relationship in said cardholder, said cardholder and cards being constructed and arranged so that at least a part of said surface-portion of the front one of said cards is visible and accessible from the front of the device;

a generally planar carrier member for a notepad;

mounting means for mounting said carrier member on said support member at an angle inclined to the front face thereof such that said carrier member is at an angle appropriate for writing on a notepad supported on said carrier member;

means for removably mounting an information-bearing element on said front face with information on said element displayed;

a calendar card mountable in a certain one of said compartments so as to partially project therefrom, said certain compartment having a wall, and spring means located in said certain compartment for urging said card against said wall, whereby said card may be held projecting from said certain compartment by selectively varying amounts;

at least one holder for writing implements, said holder being mounted on said front face; and a plurality of hook means on said front face for detachably securing small objects to said support means.

2. A device according to claim 1 wherein said carrier member is selectively mountable on said mounting means in at least two stable configurations which differ by rotation about an axis perpendicular to the plane of said carrier.

3. A device according to claim 1 wherein said support is a board and its said front face is generally planar, at least some of said compartments being defined by compartment-defining elements mounted on said front face.

* * * * *